US005593938A

United States Patent [19]

Takeuchi

[11] Patent Number: 5,593,938

[45] Date of Patent: Jan. 14, 1997

[54] THERMAL-SENSITIVE RECORDING MATERIAL

[75] Inventor: Koh Takeuchi, Shizuoka, Japan

[73] Assignee: Fuji Photo Film Co., Ltd., Kanagawa, Japan

[21] Appl. No.: 449,271

[22] Filed: May 24, 1995

[30] Foreign Application Priority Data

May 27, 1994 [JP] Japan ..... 6-115253

[51] Int. Cl.[6] ..... B41M 5/40

[52] U.S. Cl. ..... 503/206; 503/200; 503/226

[58] Field of Search ..... 427/150–152; 503/200, 226, 206

[56] References Cited

U.S. PATENT DOCUMENTS 5,418,206 5/1995 Smith ..... 503/209

FOREIGN PATENT DOCUMENTS 63-265682 11/1988 Japan .

*Primary Examiner*—B. Hamilton Hess

*Attorney, Agent, or Firm*—Sughrue, Mion, Zinn, Macpeak & Seas

[57] ABSTRACT

A thermal-sensitive recording material having reduced illusion and surface gloss when viewed with the light of a light box to provide distinct images having excellent image quality, comprising (a) a transparent support, (b) a thermal-sensitive recording layer formed on one surface of the transparent support, and (c) a light reflection reducing layer formed on the other surface of the transparent support, wherein the chromaticity coordinates according to JIS-Z8701 of the transparent support are within a quadrilateral region having 4 points A(x=0.2805, y=0.3005), B(x=0.2820, y=0.2970), C(x=0.2885, y=0.3015) and D(x=0.2870, y=0.3040) as vertices, and the thermal-sensitive recording material on the side of said light reflection reducing layer has a glossiness of from 1 to 50% at an incident angle of 20°.

4 Claims, No Drawings

THERMAL-SENSITIVE RECORDING MATERIAL

FIELD OF THE INVENTION

The present invention relates to a thermal-sensitive recording material, and more particularly to a thermal-sensitive recording material having excellent image quality in which luster and illusion of non-image portions are reduced when observed with the light of a light box to thereby enhance observation on a light box.

BACKGROUND OF THE INVENTION

Thermal-sensitive recording methods are advantageous in that (1) development is not necessary, (2) when the support is made of paper, the support is similar in quality to paper for general use, (3) treatment is easy, (4) the developed color density is high, (5) the recording apparatus is simple and inexpensive, and (6) noise is not produced in recording. The uses thereof have therefore been expanded in the field of facsimile and printers, and in the field of labels such as POS (point-of-sale). Accordingly, the demand for thermal-sensitive recording materials is diverse, and thermal-sensitive recording materials for multicolor recording and transparent thermal-sensitive recording materials for overhead projectors have also been developed as described, for example, in JP-A-63-265682 (the term "JP-A" as used herein means an "unexamined published Japanese patent application").

With recent electronic developments in medical instruments such as ultrasonic scanners, CT scanners and X-ray apparatuses, transparent thermal-sensitive recording materials have also been developed which can directly record the digital images of these instruments. In this case, when doctors, etc. conduct medical examinations, images recorded on the thermal-sensitive recording material are generally illuminated with the light of a fluorescent lamp, etc. from the backside thereof behind (such an illuminating device is called a light box) to observe the images from the support side so as not to damage the images.

However, when images recorded on a conventional thermal-sensitive recording material in which a thermal-sensitive recording layer is formed on a transparent support is observed on the light box from the support side, the following problems are encountered. First, the light of the light box passing through transparent non-image portions produces illusion, resulting in indistinct images which seem to be different from as it is. Such indistinct images are undesirable because they are in danger of causing to be made a wrong diagnosis (e.g., diagnosing a non-morbid portion as morbid, or the other way about). Second, a smooth surface of the transparent support (a side on which the thermal-sensitive recording layer is not formed) causes high luster of the images, which tends to tire the eye.

SUMMARY OF THE INVENTION

An object of the present invention is to provide a thermal-sensitive recording material having reduced illusion and surface luster when observed with the light of a light box to give distinct images having excellent image quality.

The above-described object of the present invention is achieved by a thermal-sensitive recording material comprising a transparent support, a thermal-sensitive recording layer formed on one surface of the transparent support, and a light reflection reducing layer formed on the other surface of the transparent support, wherein the chromaticity coordinates according to JIS-Z8701 of said transparent support are within a quadrilateral region having 4 points A(x=0.2805, y=0.3005), B(x=0.2820, y=0.2970), C(x=0.2885, y=0.3015) and D(x=0.2870, y=0.3040) as vertices, and thermal-sensitive recording material on the side of the light reflection reducing layer (as measured with a specular glossmeter) has a glossiness of from 1 to 50% at an incident angle of 20°.

DETAILED DESCRIPTION OF THE INVENTION

In the present invention, methods for obtaining transparent supports having chromaticity coordinates according to JIS-Z8701 within a quadrilateral region having 4 points A(x=0.2805, y=0.3005), B(x=0.2820, y=0.2970), C(x=0.2885, y=0.3015) and D(x=0.2870, y=0.3040) as vertices include (1) providing transparent resin materials such as polyethylene terephthalate, polybutylene terephthalate, cellulose triacetate, polypropylene, polystyrene, polyethylene, polyvinylidene chloride, polyacrylates and polycarbonates, and kneading blue dyes with these resins prior to film formation to form films, and (2) preparing coating solutions containing blue dyes, and applying the resulting solutions to colorless transparent resin films by known coating methods such as gravure coating, roller coating and wire coating, followed by drying.

Of these, the methods of (1) are preferred. In particular, the films are preferably formed of polyester resins such as polyethylene terephthalate and polybutylene terephthalate having blue dyes kneaded therein, and the films are subjected to heat resistant treatment, drawing treatment and antistatic treatment.

There is no particular limitation on the thickness of the support. However, the support generally has a thickness of form 25 to 200 μm.

There is no particular limitation on dyes used for coloration. However, dyes generally used in supports for X-ray films colored blue or blue-purple are preferably used. Such dyes include the dyes described in JP-B-47-8734 (the term "JP-B" as used herein means an "examined Japanese patent publication"), JP-B-47-30294 and JP-B-51-25335. The dyes can be used alone or in combination. Examples of such blue or blue-purple dyes include compounds represented by the following structural formulae:

(a)

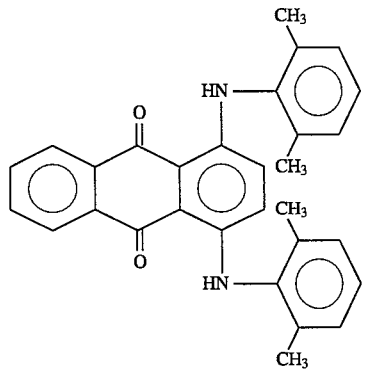

-continued
(b)
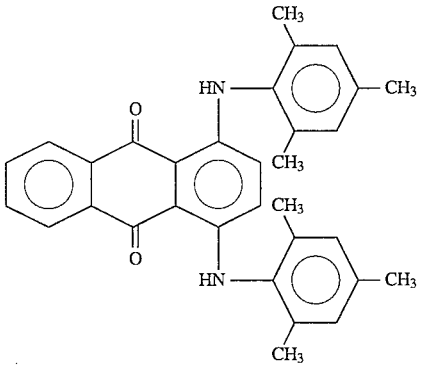
(c)
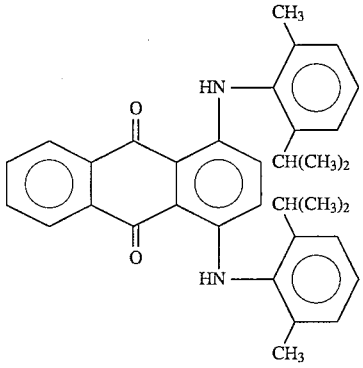
(d)
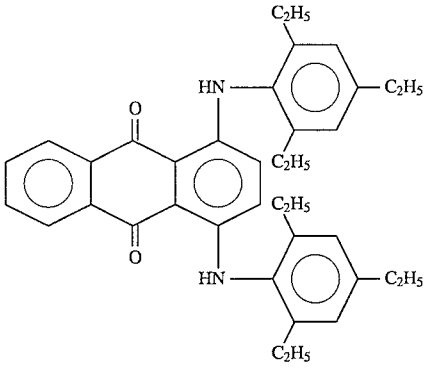
(e)
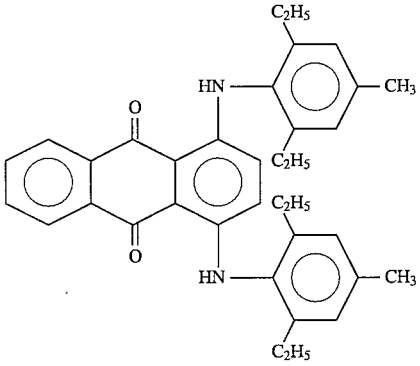
-continued
(f)
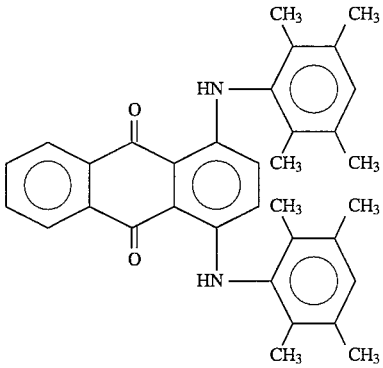
(g)
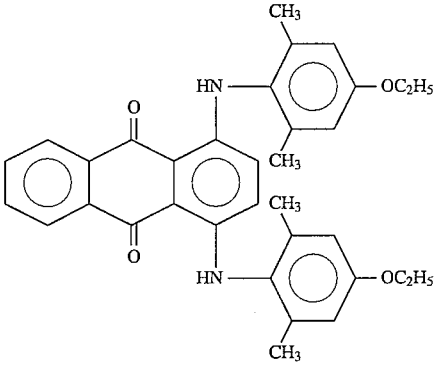
(h)
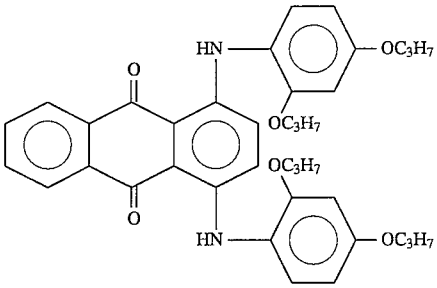
(i)
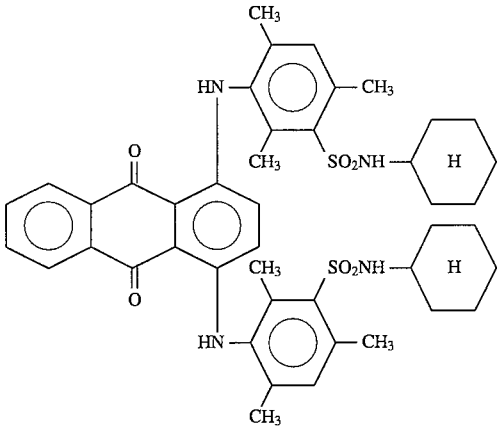

-continued (j)

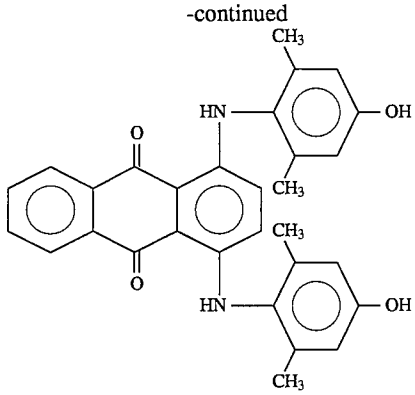

(k)

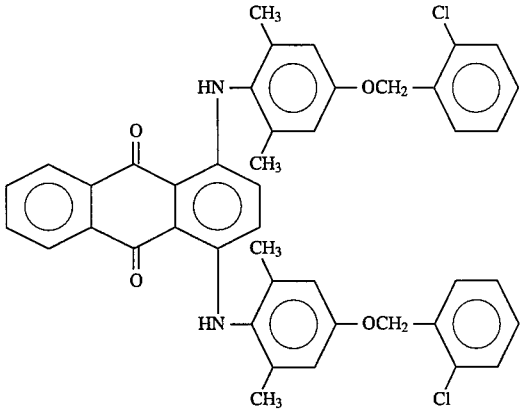

(l)

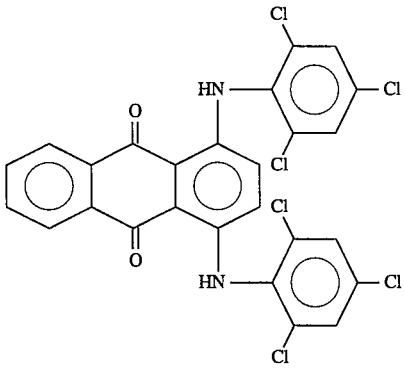

(m)

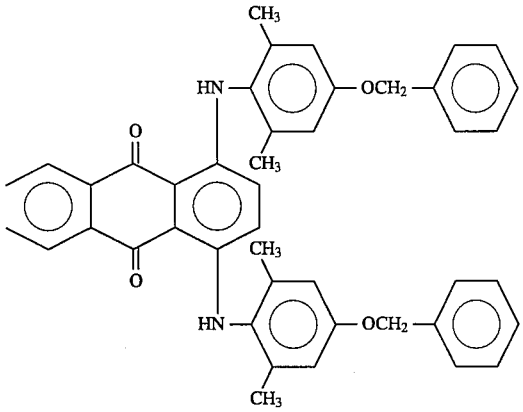

-continued (n)

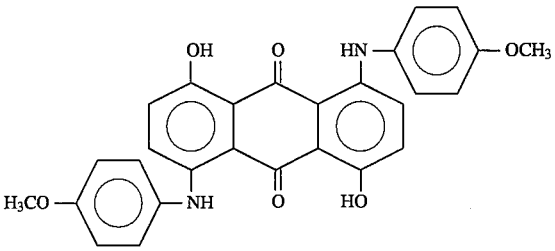

(o)

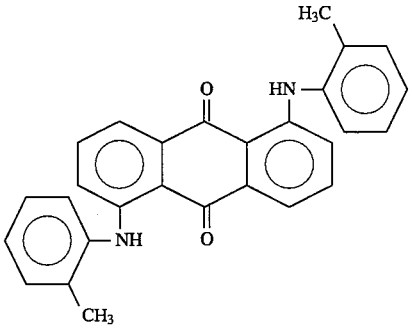

(p)

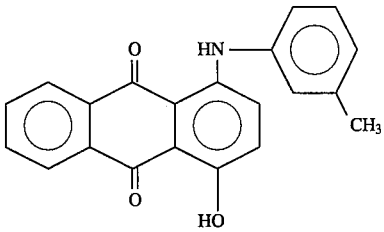

(q)

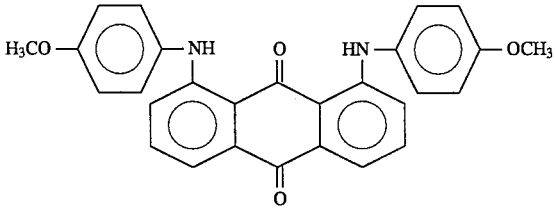

In order to provide the effect of the present invention, the kind and the amount added of the above-described dye used for coloration are selected to provide a transparent support having chromaticity coordinates according to JIS-Z8701 within the quadrilateral region having 4 points A(x=0.2805, y=0.3005), B(x=0.2820, y=0.2970), C(x=0.2885, y=0.3015) and D(x=0.2870, y=0.3040) as vertices. The chromaticity coordinates of the transparent support of the present invention are preferably within the quadrilateral region having 4 points A(x=0.2820, y=0.3000), B(x=0.2828, y=0.2977), C(x=0.2880, y=0.3013) and D(x=0.2875, y=0.3030), and more preferably 4 points A(x=0.2830, y=0.2990), B(x=0.2835, y=0.2982), C(x=0.2875, y=0.3011) and D(x=0.2870, y=0.3015), as vertices. On chromaticity coordinates with x as abscissa and y as ordinate, the region above the straight line connecting point A and point D unfavorably causes greenish blue. Furthermore, the region below the straight line connecting point B and point C unfavorably increases red tincture. Furthermore, the region on the right side of the straight line connecting point D and point C increases yellowish tint, which is unfavorable particularly for observation of images in highlighted portions. The amount of blue or blue-purple dyes contained in the transparent support of the present invention ranges from 50 to 500 ppm based on the total weight of the transparent support.

The glossiness of the support on the side of the light reflection reducing layer is measured using a specular glossmeter as glossiness to a glass surface at an incident angle of 20°, according to "Method 5" (specular gloss at an incident angle of 20°, Gs(20°)), as described in JIS-Z8741, 349–353 (1983). The glossiness of the support on the side of the light reflection reducing layer in the present invention is from 1 to 50%, and preferably from 2 to 30%. Specifically, the light reflection reducing layer of the present invention contains a polymer binder, and generally, further contains a finely divided substance. Useful polymer binders include methyl cellulose, carboxymethyl cellulose, hydroxyethyl cellulose, starch, gelatin, modified gelatin, polyvinyl alcohol, carboxy-modified polyvinyl alcohol, polyacrylamide, polystyrene and copolymers thereof, polyesters and copolymers thereof, polyethylene and copolymers thereof, epoxy resins, acrylate and methacrylate resins and copolymers thereof, polyurethane resins and polyamide resins.

The finely divided substance is contained in the light reflection layer to prevent light having wavelengths which make images indistinct by reflection from reflecting at the surface of the support. This results in recorded images of reduced luster. To achieve these effects, the particle size of the finely divided substance is preferably 1 to 20 μm, and more preferably 1 to 10 μm for adjusting luster without deterioration of image quality.

Examples of the finely divided substance include cellulose fibers, fine particles of synthetic polymers such as polystyrene resins, epoxy resins, polyurethane resins, urea-formalin resins, poly(meth)acrylate resins, polymethyl-(meth)acrylate resins, copolymer resins of vinyl chloride and vinyl acetate, and polyolefin, and fine particles of inorganic materials such as calcium carbonate, titanium oxide, kaolin, smectite clay, aluminum hydroxide, silica and zinc oxide, as well as fine particles of starch obtained from barley, wheat, corn, rice and beans.

The finely divided substance is preferably used within the range of from 0.5 to 10% by weight based on the polymer binder of the light reflection reducing layer, and more preferably within the range of from 1 to 5% by weight. Use of the finely divided substance in an amount of less than 0.5% by weight results in an insufficient light reflection effect, whereas an amount exceeding 10% by weight reduces luster, but unfavorably leads to blurry and indistinct images.

In the thermal-sensitive recording layer provided on the transparent support of the present invention, a color former and a developer which are isolated from each other at ordinary temperatures (e.g., room temperature) are brought into contact with each other by heating to develop color and thereby record images.

The color former and the developer induce a color developing reaction by bringing these components into contact with each other, although each is substantially colorless prior to color development. A combination of a precursor (color former) of an electron donating dye and an acidic substance (developer) or a combination of a diazo compound (color former) and a coupling agent (developer) is preferably used. In particular, the former combination is preferably employed for enhanced image distinctness.

There is no particular limitation on the electron donating colorless dye, as long as it is substantially colorless. Substantially colorless compounds are preferably used which can donate electrons or accept protons such as acids to thereby develop color. These compounds have partial skeletons such as lactone, lactam, sultone, spiropyran, ester and amide skeletons, and come into contact with developers to open or cleave these partial skeletons. Examples of the color formers include compounds such as triphenylmethanephthalide compounds, fluoran compounds, phenothiazine compounds, indolylphthalide compounds, leucoauramine compounds, rhodamine lactam compounds, triphenylmethane compounds, triazene compounds, spiropyran compounds and fluorene compounds. Examples of the phthalide compounds are described in U.S. Reissued Pat. No. 23,024 and U.S. Pat. Nos. 3,491,111, 3,491,112, 3,491,116 and 3,509,174. Examples of the fluoran compounds are described in U.S. Pat. Nos. 3,624,107, 3,627,787, 3,641,011, 3,462,828, 3,681,390, 3,920,510 and 3,959,571. Examples of the spirodipyran compounds are described in U.S. Pat. No. 3,971,808. Examples of pyridine and pyrazine compounds are described in U.S. Pat. Nos. 3,775,424, 3,853,869 and 4,246,318, and examples of the fluorene compounds are described in JP-A-63-94878.

Of these, 2-arylamino-3-H, halogen, alkyl or alkoxy-6-substituted aminofluoran compounds which develop a black color are particularly effective. Examples thereof include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylamino-fluoran, 2-anilino-3-chloro-6-diethylaminofluoran, 2-anilino-3-methyl-6-N-ethyl-N-2-anilino-3-methyl-6-N-ethyl-N-isoamylaminofluoran, dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylaminofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran and 2-anilino-3-methyl-6-N-ethyl-N-γ-propoxypropylaminofluoran.

Useful developers for these color formers include acidic substances such as phenol compounds, organic acid or metal salts thereof and oxybenzoates. Examples thereof are described in JP-A-61-291183. Examples of the developers include bisphenols such as 2,2-bis(4'-hydroxyphenyl)propane (generally called "bisphenol A"), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methylpentane, 1,1-bis(4'-hydroxyphenyl)-2-ethylhexane, 1,1-bis(4'-hydroxyphenyl-)dodecane, 1,4-bis(phydroxyphenylcumyl)benzene, 1,3-bis(p-hydroxyphenylcumyl)benzene, bis(p-hydroxyphenyl)sulfone, bis(3-allyl-4-hydroxyphenyl)sulfone and bis(p-hydroxyphenyl)acetic acid benzyl ester; salicylic acid derivatives such as 3,5-di-α-methylbenzylsalicylic acid, 3,5-t-butylsalicylic acid, 3-α-α-dimethylbenzylsalicylic acid and 4-(β-p-methoxyphenoxyethoxy)salicylic acid or multivalent metal salts thereof (zinc and aluminum are particularly preferred); oxybenzoates such as benzyl p-hydroxybenzoate, 2-ethylhexyl p-hydroxybenzoate and 2-phenoxyethyl β-resorcylate; and phenols such as p-phenylphenol, 3,5-diphenylphenol, cumylphenol, 4-hydroxy-4'-isopropoxydiphenylsulfone and 4-hydroxy-4'-phenoxydiphenylsulfone. Of these, bisphenols are preferred for improving color development. The developer is preferably used in an amount of from 50 to 800% by weight of the color former, and more preferably in an amount of from 100 to 500% by weight. Two or more of the above-described electron accepting compounds may be used in combination. The coverage of the color former in the thermal-sensitive recording layer is generally 0.5 to 10 g/m$^2$, and preferably 1 to 5 g/m$^2$.

The diazo compounds for use in the present invention are compounds which react with the developers called "coupling components" described below to produce desired hues. These are photodecomposable diazo compounds which decompose on being exposed to light of specified wavelengths prior to reaction, and the decomposed compounds no longer have color developing ability even if the coupling components act thereon. The hues in this color developing system are determined by diazo dyes produced by reaction of the diazo compounds with the coupling components. It is well known that changes in the chemical structure of the diazo compounds or the coupling components readily change the hues thus produced. Thus, the desired hues can be obtained by selecting an appropriate combination of components.

The photodecomposable diazo compound for use in the present invention is generally an aromatic diazo compound. Examples thereof are aromatic diazonium salts, diazosulfonate compounds and diazoamino compounds. The diazonium salts are compounds represented by the general formula $ArN_2^+X^-$, wherein Ar represents a substituted or unsubstituted aromatic moiety, $N_2^+$ represents a diazonium group, and $X^-$ represents an acid anion. A number of diazosulfonate compounds are known and obtained by treating diazonium salts with sulfites. The diazoamino compounds are obtained by coupling diazo groups with dicyandiamide, sarcosine, methyltaurine, N-ethylanthranilic acid-5-sulfonic acid, monoethanolamine, diethanolamine, guanidine, etc. Details of these diazo compounds are described, for example, in JP-A-2-136286, etc.

The coupling components which react by coupling with the diazo compounds for use in the present invention include, for example, the compounds described in JP-A-62-146678 including resorcin, as well as aniline 2-hydroxy-3-naphthoate.

When a combination of the diazo compound and the coupling component is used in the present invention, a basic substance may be added to promote the coupling reaction. A water-insoluble or slightly soluble basic substance or a substance producing an alkali by heating is used as the basic substance. Examples thereof include nitrogen-containing compounds such as inorganic and organic ammonium salts, organic amines, amides, urea and derivatives thereof, thiourea and derivatives thereof, thiazole derivatives, pyrrole derivatives, pyrimidine derivatives, piperazine derivatives, guanidine derivatives, indole derivatives, imidazole derivatives, imidazoline derivatives, triazole derivatives, morpholine derivatives, piperidine derivatives, amidine derivatives, formamidine derivatives and pyridine derivatives. Specifically, they are described, for example, in JP-A-61-291183, etc. Two or more of these basic substances may be used in combination.

The color formers or the developers for use in the present invention can be dispersed as a solid in the thermal-sensitive recording layer by known methods. However, these compounds are preferably used in capsule form to improve transparency of the thermal-sensitive recording layer, to prevent the color former from coming into contact with the developer at ordinary temperatures to thereby enhance storage stability (antifogging property), and to control the color development sensitivity of developing color at a desired thermal energy.

Microcapsules for use in the present invention may be prepared by any of interfacial polymerization, internal polymerization and external polymerization. In particular, interfacial polymerization is preferably used in which a core material containing an electron donative colorless dye, a diazonium salt, etc. is emulsified in an aqueous solution of a water-soluble compound, followed by formation of polymer walls around oil droplets thereof.

A reactant forming the polymer is added to the inside and/or the outside of the oil droplets. Examples of the polymers include polyurethanes, polyureas, polyamides polyesters, polycarbonates, urea-formaldehyde resins, melamine resins, polystyrene, styrene-methacrylate copolymers and styrene-acrylate copolymers. Of these, polyurethanes, polyureas, polyamides polyesters and polycarbonates are preferred, and polyurethanes and polyureas are particularly preferred. Two or more of the polymers may be used in combination. Examples of the above-described water-soluble compounds include gelatin, polyvinylpyrrolidone and polyvinyl alcohol.

For example, when the polyurea is used as the capsule wall material, a polyisocyanate such as a diisocyanate, a triisocyanate, a tetraisocyanate or a polyisocyanate prepolymer, and a polyamine such as a diamine, a triamine or a tetraamine, a prepolymer having two or more amino groups; piperazine or a derivative thereof; or a polyol are reacted by interfacial polymerization in an aqueous solvent, to thereby easily form microcapsule walls.

Furthermore, composite walls formed of the polyurea and the polyamide or formed of the polyurethane and the polyamide can be prepared by using, for example, a polyisocyanate and an acid chloride, or a polyamine and a polyol, and adjusting the pH of an emulsifying medium constituting a reaction solution, followed by heating. Details of the preparation of composite walls formed of a polyurea and a polyamide are described in JP-A-58-66948.

Furthermore, the microcapsule walls for use in the present invention may contain a metal-containing dye, a charge regulating agent or other additives as needed. These additives can be added to the capsule walls in forming the walls or at other steps of the process. In addition, a monomer such as a vinyl monomer may be graft polymerized to thereto adjust the charge property of the surfaces of the capsule walls as needed.

In the present invention, in order to impart material permeability to the microcapsules at lower temperatures, plasticizers preferably having a melting point of from 50° C. to 120° C., and which are solid at ordinary temperatures, can be selected from among appropriate polymers for forming the microcapsule walls. For example, when the wall material is formed of polyurea and polyurethane, plasticizers such as hydroxy compounds, carbamic acid ester compounds, aromatic alkoxy compounds, organic sulfonamide compounds, arylamide compounds, etc. can be added thereto.

In order to improve storage stability, the color formers are preferably encapsulated and the developers are used as emulsified dispersions.

In the present invention, the above-described developers can be used in the form of a solid dispersion. However, to improve the transparency of the thermal-sensitive recording layer and the light transmittance of the thermal-sensitive recording material, the above-described developers are preferably used in the form of an emulsified dispersion. This is achieved by dissolving the developers in water-insoluble or slightly soluble organic solvents, and then, mixing the resulting solutions with aqueous phases containing water-soluble polymers having surfactants as protective colloids.

The organic solvents for emulsification can be appropriately selected from high boiling oils. Preferred examples thereof include dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phenylmethane, triallylmethanes (for example, tritolylmethane and tolyldiphenylmethane), terphenyl compounds (for example, terphenyl), alkyl compounds, alkylated diphenyl ethers (for example, propyl diphenyl ether), hydrogenated terphenyl compounds (for example, hexahydroterphenyl) and diphenyl ether, as well as esters. Of these, esters are preferably used to promote emulsion stability of the emulsified dispersions.

The esters include phosphates (for example, triphenyl phosphate, tricresyl phosphate, butyl phosphate, octyl phosphate and cresylphenyl phosphate), phthalates (for example, dibutyl phthalate, 2-ethylhexyl phthalate, ethyl phthalate, octyl phthalate and butylbenzyl phthalate), dioctyl tetrahydrophthalate, benzoates (for example, ethyl benzoate, propyl benzoate, butyl benzoate, isopentyl benzoate and benzyl benzoate), abietates (for example, ethyl abietate and benzyl abietate), dioctyl adipate, isodecyl succinate, dioctyl azelate, oxalates (for example, dibutyl oxalate and dipentyl oxalate), diethyl malonate, maleates (for example, dimethyl maleate, diethyl maleate and dibutyl maleate), tributyl citrate, sorbates (for example, methyl sorbate, ethyl sorbate and butyl sorbate), sebacates (for example, dibutyl sebacate and dioctyl sebacate), ethylene glycol esters (for example, formic acid monoester and diester, butyric acid monoester and diester, lauric acid monoester and diester, palmitic acid monoester and diester, stearic acid monoester and diester, and oleic acid monoester and diester), triacetin, diethyl carbonate, diphenyl carbonate, ethylene carbonate, propylene carbonate and borates (for example, tributyl borate and tripentyl borate). Of these, tricresyl phosphate is preferably used alone or in combination with other esters for best emulsion stability. The abovementioned oils can be used in combination with each other or with another oil.

In the present invention, supplemental solvents having low boiling point can also be further added to assist in dissolving the developer components. Particularly preferred examples of such supplemental solvents include ethyl acetate, isopropyl acetate, butyl acetate and methylene chloride.

The water-soluble polymers contained as protective colloids in the aqueous phase to be mixed with the oil phase developer solution are appropriately selected from known anionic polymers, nonionic polymers and amphoteric polymers. In particular, polyvinyl alcohol, gelatin and cellulose derivatives are preferably used.

Furthermore, the surfactants contained in the aqueous phase are selected from among anionic and nonionic surfactants so as not to induce precipitation or coagulation of the above described protective colloids. Preferred examples of the surfactants include sodium alkylbenzenesulfonates, sodium alkylsulfates, dioctyl sulfosuccinate sodium salt and polyalkylene glycols (for example, polyoxyethylene nonylphenyl ether).

The emulsified dispersion in the present invention can be easily obtained by mixing the oil phase containing the above-described components with the aqueous phase containing the protective colloid and the surfactant by use of known means-for fine particle emulsification such as high speed stirring or ultrasonic dispersion.

Furthermore, the ratio of the oil phase to the aqueous phase (the weight of the oil phase/the weight of the aqueous phase) is preferably from 0.02 to 0.6, and more preferably from 0.1 to 0.4. If the ratio is less than 0.02, the dispersion is too dilute to obtain sufficient color development. Conversely, if the ratio is more than 0.6, the viscosity of the dispersion is increased, which causes inconvenient handling and a decrease in coating dispersion stability.

When the dispersion for the thermal-sensitive recording layer prepared as described above is applied to the support, a known coating means using a aqueous or organic solvent coating liquid is employed. In this case, in order to apply the dispersion for the thermal-sensitive recording layer safely and uniformly, and to maintain the strength of a coated film, methyl cellulose, carboxymethyl cellulose, hydroxyethyl cellulose, starch, gelatin, polyvinyl alcohol, carboxy-modified polyvinyl alcohol, polyacrylamide, polystyrene or a copolymer thereof, a polyester or a copolymer thereof, polyethylene or a copolymer thereof, an epoxy resin, an acrylate or methacrylate resin or a copolymer thereof, a polyurethane resin or a polyamide resin can be used in combination with the microcapsules.

The thermal-sensitive recording layer may contain a pigment, wax, a hardening agent, etc. as needed. The thermal-sensitive recording layer is preferably formed so as to provide a total coverage of the color former and the developer of from 0.1 to 10 g/m$^2$ and a layer thickness of from 1 to 20 μm.

In the present invention, for preventing the thermal-sensitive recording layer and the light reflection reducing layer from separating from the support, a subbing layer is preferably formed on the support before application of the thermal-sensitive recording layer containing the microcapsules, etc. and the light reflection reducing layer. The subbing layer can be formed of an acrylate copolymer, polyvinyl chloride, SBR, an aqueous polyester or the like, and the film thickness thereof is preferably from 0.1 to 0.5 μm.

When the thermal-sensitive recording layer and the light reflection reducing layer are formed on the subbing layer, the subbing layer swells with moisture contained in the thermal-sensitive recording layer and the light reflection reducing layer. This sometimes results in deterioration of images recorded on the thermal-sensitive recording layer. Therefore, the layer is preferably hardened by use of a hardening agent such as a dialdehyde, for example, glutaraldehyde or 2,3-dihydroxy-1,4-dioxane, and boric acid. The addition amount of these hardening agents is suitably selected to provide the desired hardening degree depending on the weight of the subbing materials within the range of from 0.20 to 3.0% by weight based on the total weight of the subbing layer.

In the present invention, in order to prevent lowering of the apparent transparency by light scattering on the surface of the thermal-sensitive recording layer, a protective layer is preferably formed on the thermal-sensitive recording layer by known methods. Details of the protective layer are described, for example, in *Kami Pulp Gijutsu Times* (*Paper Pulp Technical Times*), pages 2–4, (September, 1985) and JP-A-63-318546.

For providing improved transparency of the protective layer, completely saponified polyvinyl alcohol, carboxy-modified polyvinyl alcohol, silica-modified polyvinyl alcohol, etc. are particularly preferred as a material of the protective layer. The protective layer may contain a known hardening agent, wax, pigment, etc.

In the present invention, a protective layer mainly composed of a silicone resin may be provided over the above-described protective layer or in place thereof. This improves water resistance without deteriorating the transparency of the thermal-sensitive recording layer.

The thermal-sensitive recording layer, the protective layer, the light reflection reducing layer and the subbing layer are applied by known coating methods such as blade coating, air knife coating, gravure coating, roller coating, spray-coating, dip coating and bar coating.

The present invention will be described in detail with reference to the Examples given below, but these Examples are not to be construed as limiting the invention. All percentages are by weight, unless otherwise indicated.

EXAMPLE 1

Preparation of Capsule Dispersion

2-Anilino-3-methyl-6-N-ethyl-N-butylaminofluoran (16 g) as a color former and 10 g of Takenate D-110N (trade name of a capsule wall agent manufactured by Takeda Chemical Industries, Ltd.) were dissolved in a mixed solvent of 20 g of ethyl acetate and 5 g of methylene chloride. The resulting solution was mixed with an aqueous phase obtained by mixing 400 g of an 8% aqueous solution of polyvinyl alcohol, 15 g of water and 0.5 g of a 2% aqueous solution of dioctyl sulfosuccinate sodium salt (surfactant), followed by emulsification using an Ace homogenizer (manufactured by Nippon Seiki Co., Ltd.) at 10,000 rpm for 5 minutes. To the resulting emulsion, 70 g of water was further added, followed by conducting an encapsulating reaction at 40° C. for 3 hours to prepare an emulsified dispersion of capsules having an average particle size of 0.7 μm. The value of the 50% volume average particle size measured with a laser diffraction particle size distribution analyzer manufactured by Horiba, Ltd. was used to measure the average particle size.

Preparation of Emulsified Dispersion of Developers

A developer (4 g) represented by the following structural formula (1):

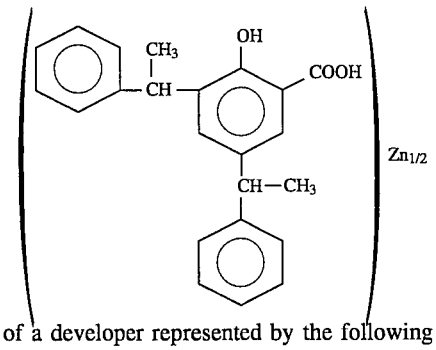

(1)

2 g of a developer represented by the following structural formula (2):

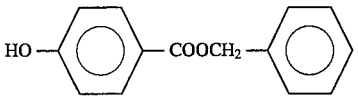

(2)

and 15 g of a developer represented by the following structural formula (3):

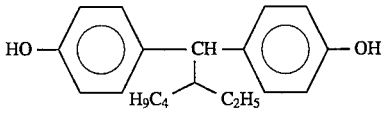

(3)

were dissolved in a mixed solvent of 4 g of 1-phenyl-1-xylylethane and 15 g of ethyl acetate. The resulting solution was mixed with an aqueous phase obtained by mixing g of an 8% aqueous solution of polyvinyl alcohol, 15 g of water and 0.5 g of sodium dodecylbenzenesulfonate, followed by emulsification using an Ace homogenizer (manufactured by Nippon Seiki Co., Ltd.) at 10,000 rpm so as to give an average particle size of 0.5 μm.

Preparation of Protective Layer Dispersion A

With 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt, 3 g of a kaolin dispersion obtained by previously mixing 100 g of a 3% aqueous solution of polyvinyl alcohol (PVA 205, manufactured by Kuraray Co., Ltd.) with 35 g of kaolin, followed by dispersing in a ball mill, and 0.5 g of a 30% dispersion of zinc stearate (Z-7-30, manufactured by Chukyo Yushi Co., Ltd.) were mixed to prepare protective layer dispersion A.

Preparation of Light Reflection Reducing Layer Dispersion A

Wheat starch (0.1 g) having a 50% volume average particle size of 14.5 μm was mixed with 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt using a stirrer to prepare light reflection reducing layer dispersion A.

Preparation of Thermal-Sensitive Recording Material and Evaluation Thereof

A dispersion obtained by stirring a mixture of 5.0 g of the above-described capsule dispersion, 10.0 g of the above-described emulsified dispersion of the developers and 5 g of water was applied to a polyethylene terephthalate (PET) support having a thickness of 70 μm and colored in blue to provide chromaticity coordinates (x=0.2850, y=0.2995), so as to give a solid amount of 15 g/m$^2$, and then dried to form a thermal-sensitive recording layer. Then, the above-described protective layer dispersion A was applied to the thermal-sensitive recording layer thus formed so as to give a dry thickness of 2 μm, and then dried to prepare a transparent thermal-sensitive recording material. Subsequently, the above-described light reflection reducing layer dispersion A was applied to a surface of the thermal-sensitive recording material opposite the side on which the thermal-sensitive recording layer was formed, so as to give a solid amount of 1.0 g/m$^2$, and then dried to provide a light reflection reducing layer, thus preparing a transparent thermal-sensitive recording material of the present invention. Using the resulting thermal-sensitive recording material, images were recorded using a thermal printer (FTI-1000, manufactured by Fuji Photo Film Co., Ltd.). The glossiness of the light reflection reducing layer side measured with a specular glossmeter (digital deformation glossmeter UGV-5D, manufactured by Suga Test Instruments Co., Ltd.) at an incident angle of 20° based on a glass surface was 28%. The recorded images were observed as transmitted images using a light box. The resulting images were distinct with no illusion, and had reduced luster. The haze value showing the transparency of a ground portion thereof was 25%. The haze value was measured with a haze meter HGM-2DP (manufactured by Suga Test Instruments Co., Ltd.). The haze is a value indicated by the following equation:

$$\frac{\left(\begin{array}{c}\text{Total quantity of}\\ \text{transmitted light}\end{array}\right)-\left(\begin{array}{c}\text{Quantity of diffuse}\\ \text{transmitted light}\end{array}\right)}{(\text{Total quantity of transmitted light})}\times 100\ (\%)$$

The lower this value, the higher the transparency.

EXAMPLE 2

Methylene chloride (15 g), 5 g of tricresyl phosphate, 15 g of trimethylolpropane trimethacrylate and 20 g of a 75% ethyl acetate solution of the 3:1 adduct of m-xylylene diisocyanate and trimethylolpropane (Takenate D-110N, manufactured by Takeda Chemical Industries, Ltd.) were added to 5 g of a diazonium compound represented by the following structural formula (4):

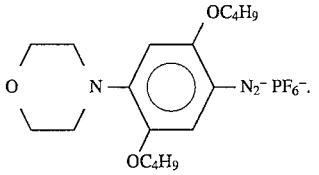

(4)

These components were uniformly mixed to prepare an oil phase solution.

The resulting oil phase solution was mixed with 60 g of a 7% aqueous solution of polyvinyl alcohol (PVA 217E, manufactured by Kuraray Co., Ltd.), followed by emulsification using an Ace homogenizer (manufactured by Nippon Seiki Co., Ltd.) at 8,000 rpm for 5 minutes. To the resulting emulsion, 50 g of water was further added, followed by conducting an encapsulating reaction at 40° C. for 3 hours to prepare an emulsified dispersion of capsules having an average particle size of 1.5 μm. After termination of the reaction, 10 ml of an ion exchange resin (MB-3, manufactured by Japan Organo Co., Ltd.) was added to the resulting dispersion, and the mixture was stirred for 30 minutes, followed by filtering to obtain a capsule dispersion.

A coupler compound (4.3 g) represented by the following structural formula (5):

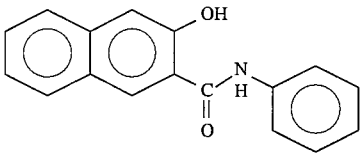

(5)

0.7 g of a coupler compound represented by the following structural formula (6):

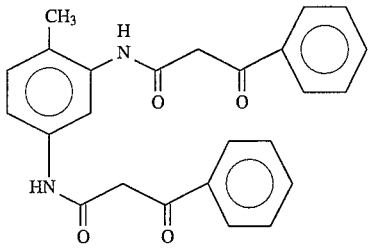

(6)

5 g of 1,2,3-triphenylguanidine, 0.8 g of tricresyl phosphate and 0.2 g of diethyl maleate were dissolved in 25 g of ethyl acetate. The resulting solution was mixed with an aqueous phase obtained by mixing 40 g of an 8% aqueous solution of polyvinyl alcohol, 15 g of water and 0.5 g of sodium dodecylbenzenesulfonate, followed by emulsification using an Ace homogenizer (manufactured by Nippon Seiki Co., Ltd.) at 10,000 rpm so as to give an average particle size of 0.5 μm.

Preparation of Thermal-Sensitive Recording Material and Evaluation Thereof

A thermal-sensitive recording material was prepared and evaluated in the same manner as in Example 1, except that 5.0 g of a capsule dispersion containing the above-described diazonium compound was mixed with 10 g of the coupler emulsion and the mixed dispersion was applied so as to give a solid amount of 15 g/m$^2$. The specular glossiness measured on the light reflection reducing layer side of the resulting thermal-sensitive recording material was 28%. Recorded images were observed as transmitted images using a light box. The resulting images were distinct with no illusion, and had reduced luster. The haze value showing the transparency of a ground portion thereof was 27%.

EXAMPLE 3

2-Anilino-3-methyl-6-N-dibutylaminofluoran (30 g) as a color former, 30 g of bisphenol A as a developer and 30 g of β-naphthyl benzyl ether as a sensitizer were each added to 150 g of a 5% aqueous solution of polyvinyl alcohol (PVA-105, manufactured by Kuraray Co., Ltd.), and dispersed together with 230 cc of glass beads having a particle size of 0.8 mm in a dynomill (KDL type, manufactured by Shinmaru Enterprises Co.) until the particle size reached 0.5 μm for each of the color former, the developer and the sensitizer. The value of the 50% volume average particle size measured with a laser diffraction particle size distribution analyzer LA-500 manufactured by Horiba, Ltd. was used to measure the particle size of each of the dispersions. The color former dispersion (5 g), 10 g of the developer dispersion and 10 g of the sensitizer dispersion thus prepared were mixed, and 10% polyvinyl alcohol (PVA-105, manufactured by Kuraray Co., Ltd.) was further added so as to give a solid content of 40% based on the total weight, thus obtaining a coating dispersion.

A thermal-sensitive recording material was prepared and evaluated in the same manner as in Example 1, except that the above-described coating dispersion was used as a coating dispersion for a thermal-sensitive recording layer. The specular glossiness measured on the light reflection reducing layer side of the resulting thermal-sensitive recording material was 27%. Recorded images were observed as transmitted images using a light box. The resulting images were distinct with no illusion, and had reduced luster. The haze value showing the transparency of a ground portion thereof was 37%, which caused no practical problems in observing the images on the light box.

EXAMPLE 4

Preparation of Light Reflection Reducing Layer Dispersion B

Rice starch (0.1 g) having a 50% volume average particle size of 7.5 μm was mixed with 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt using a stirrer to prepare light reflection reducing layer dispersion B.

A thermal-sensitive recording material was prepared and evaluated in the same manner as in Example 1, except that light reflection reducing layer dispersion B was used. The specular glossiness measured on the light reflection reducing layer side of the resulting thermal-sensitive recording material was 22%. Recorded images were observed as transmitted images using a light box. The resulting images were distinct with no illusion, and had reduced luster. The haze value showing the transparency of a ground portion thereof was 26%.

EXAMPLE 5

Preparation of Light Reflection Reducing Layer Dispersion C

A polymethyl methacrylate resin (0.1 g) having a 50% volume average particle size of 2.5 μm was mixed with 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt using a stirrer to prepare light reflection reducing layer dispersion C.

A thermal-sensitive recording material was prepared and evaluated in the same manner as in Example 1, except that light reflection reducing layer dispersion C was used. The specular glossiness measured on the light reflection reducing layer side of the resulting thermal-sensitive recording material was 15%. Recorded images were observed as transmitted images using a light box. The resulting images were distinct with no illusion, and had reduced luster. The haze value showing the transparency of a ground portion thereof was 23%.

EXAMPLE 6

Preparation of Light Reflection Reducing Layer Dispersion D

Finely divided amorphous silica particles (0.1 g) having a 50% volume average particle size of 1.2 μm were mixed with 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt using a stirrer to prepare light reflection reducing layer dispersion D.

A thermal-sensitive recording material was prepared and evaluated in the same manner as in Example 1, except that light reflection reducing layer dispersion D was used. The specular glossiness measured on the light reflection reducing layer side of the resulting thermal-sensitive recording material was 14%. Recorded images were observed as transmitted images using a light box. The resulting images were distinct with no illusion, and had reduced luster. The haze value showing the transparency of a ground portion thereof was 23%.

EXAMPLE 7

A thermal-sensitive recording material was prepared and evaluated in the same manner as in Example 1, except that a polyethylene terephthalate (PET) support having a thickness of 70 μm and colored in blue to provide chromaticity coordinates (x=0.2870, y=0.3010) was used as a support. The specular glossiness measured on the light reflection reducing layer side of the resulting thermal-sensitive recording material was 28%. Recorded images were observed as transmitted images using a light box. The resulting images were distinct with no illusion, and had reduced luster. Blue coloration of a portion at which color was not developed was hardly visually distinguishable from the thermal-sensitive recording material of Example 1. The haze value showing the transparency of a ground portion thereof was 27%.

EXAMPLE 8

A thermal-sensitive recording material was prepared and evaluated in the same manner as in Example 1, except that a polyethylene terephthalate (PET) support having a thickness of 70 μm and colored in blue to provide chromaticity coordinates (x=0.2825, y=0.3000) was used as a support. The specular glossiness measured on the light reflection reducing layer side of the resulting thermal-sensitive recording material was 28%. Recorded images were observed as transmitted images using a light box. The resulting images were distinct with no illusion, and had reduced luster. Blue coloration of a portion at which color was not developed was hardly visually distinguishable from the thermal-sensitive recording material of Example 1. The haze value showing the transparency of a ground portion thereof was 27%.

COMPARATIVE EXAMPLE 1

A thermal-sensitive recording material was prepared and evaluated in the same manner as in Example 1, except that a transparent uncolored polyethylene terephthalate (PET) support having a thickness of 70 μm was used as a support. The specular glossiness measured on the light reflection reducing layer side of the resulting thermal-sensitive recording material was 28%. Recorded images were observed as transmitted images by using a light box. Illusion developed in the boundaries between the images and non-image portions, which made it difficult to observe the images and also tired the eyes of the observers. The haze value showing the transparency of a ground portion thereof was 27%.

COMPARATIVE EXAMPLE 2

A thermal-sensitive recording material was prepared and evaluated in the same manner as in Example 1, except that a polyethylene terephthalate (PET) support having a thickness of 70 μm and colored in blue to provide chromaticity coordinates (x=0.2900, y=0.3040) was used as a support. The specular glossiness measured on the light reflection reducing layer side of the resulting thermal-sensitive recording material was 28%. Recorded images were observed as transmitted images using a light box. The non-image portions showed a yellowish tint darker than that of the recording material of Example 1, and particularly, the images were indistinct in highlighted portions. The haze value showing the transparency of a ground portion was thereof 27%.

COMPARATIVE EXAMPLE 3

A thermal-sensitive recording material was prepared and evaluated in the same manner as in Example 1, except that a polyethylene terephthalate (PET) support having a thickness of 70 μm and colored in blue to provide chromaticity coordinates (x=0.2870, y=0.2995).was used as a support. The specular glossiness measured on the light reflection reducing layer side of the resulting thermal-sensitive recording material was 29%. Recorded images were observed as transmitted images using a light box. The non-image portions showed a tincture of red darker than that of the recording material of Example 1, and the images were indistinct. The haze value showing the transparency of a ground portion thereof was 26%.

COMPARATIVE EXAMPLE 4

A thermal-sensitive recording material was prepared and evaluated in the same manner as in Example 1, except that a polyethylene terephthalate (PET) support having a thickness of 70 μm and colored in blue to provide chromaticity coordinates (x=0.2825, y=0.3035) was used as a support. The specular glossiness measured on the light reflection reducing layer side of the resulting thermal-sensitive recording material was 28%. Recorded images were observed as transmitted images using a light box. The non-image portions showed a greenish tint darker than that of the recording material of Example 1, and the images were indistinct. The haze value showing the transparency of a ground portion thereof was 27%.

COMPARATIVE EXAMPLE 5

A thermal-sensitive recording material was prepared and evaluated in the same manner as in Example 1, except that the light reflection reducing layer was not provided on the surface opposite to the thermal-sensitive recording layer. The specular glossiness measured on the side opposite to the thermal recording layer of the resulting thermal-sensitive recording material was 123%. Recorded images were observed as transmitted images using a light box. The resulting images were distinct, but the luster was too strong to observe the images. The haze value showing the transparency of a ground portion thereof was 20%.

COMPARATIVE EXAMPLE 6

Preparation of Light Reflection Reducing Layer Dispersion E

Wheat starch (0.1 g) having a 50% volume average particle size of 25 μm was mixed with 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt using a stirrer to prepare light reflection reducing layer dispersion E.

A thermal-sensitive recording material was prepared and evaluated in the same manner as in Example 1, except that light reflection reducing layer dispersion E was used. The specular glossiness measured on the light reflection reducing layer side of the resulting thermal-sensitive recording material was 37%. Recorded images were observed as transmitted images using a light box. The existence of fine particles was visually observed, which made it difficult to observe the images. Furthermore, during handling of the recording material, the fine particles partially dropped out of the light reflection reducing layer. The haze value showing the transparency of a ground portion thereof was 24%.

COMPARATIVE EXAMPLE 7

Preparation of Light Reflection Reducing Layer Dispersion F

Finely divided aluminum hydroxide particles (0.1 g) having a 50% volume average particle size of 0.5 μm were mixed with 20 g of a 10% aqueous solution of polyvinyl alcohol (PVA 124, manufactured by Kuraray Co., Ltd.), 30 g of water and 0.3 g of a 2% aqueous solution of dioctyl sulfosuccinate sodium salt using a stirrer to prepare light reflection reducing layer dispersion F.

A thermal-sensitive recording material was prepared and evaluated in the same manner as in Example 1, except that light reflection reducing layer dispersion F was used. The specular glossiness measured on the light reflection reducing layer side of the resulting thermal-sensitive recording material was 64%. Recorded images were observed as transmitted images using a light box. The luster of the recording material was remarkable, although not so strong as that of the recording material of Comparative Example 5, which made it difficult to observe the images. The haze value showing the transparency of a ground portion thereof was 21%.

The thermal-sensitive recording material of the present invention has reduced illusion and surface luster when observed with the light of a light box to give distinct images having excellent image quality.

While the invention has been described in detail and with reference to specific examples, it will be apparent to one skilled in the art that various changes and modifications can be made without departing from the spirit and scope thereof.

What is claimed is:

1. A thermal-sensitive recording material comprising (a) a transparent support, (b) a thermal-sensitive recording layer formed on one surface of the transparent support, and (c) a light reflection reducing layer formed on the other surface of the transparent support, wherein the chromaticity coordinates according to JIS-Z8701 of said transparent support are within a quadrilateral region having 4 points A(x =0.2805, y=0.3005), B(x=0.2820, y=0.2970), C(x=0.2885, y=0.3015) and D(x=0.2870, y=0.3040) as vertices, and the thermal-sensitive recording material on the side of said light reflection reducing layer has a glossiness of from 1 to 50% at an incident angle of 20°.

2. The thermal-sensitive recording material according to claim 1, wherein the light reflection reducing layer contains finely divided particles having an average particle diameter of from 1 to 20 μm.

3. The thermal-sensitive recording material according to claim 2, wherein the light reflection reducing layer contains a polymer binder and finely divided particles in an amount of from 0.5 to 10% by weight based on the weight of the polymer binder.

4. The thermal-sensitive recording material according to claim 1, wherein the thermal-sensitive recording material on the side of the light reflection receiving layer has a glossiness of from 2 to 30% at an incident angle of 20%.

* * * * *